US006422145B1

(12) United States Patent
Gavrilovic et al.

(10) Patent No.: US 6,422,145 B1
(45) Date of Patent: Jul. 23, 2002

(54) CONTROLLED ELECTROMAGNETIC INDUCTION DETONATION SYSTEM FOR INITIATION OF A DETONATABLE MATERIAL

(75) Inventors: Mihailo Gavrilovic, Golden, CO (US); Keith Wright, Dienella (AU)

(73) Assignee: RockTek Ltd. (AU)

( * ) Notice: Subject to any disclaimer, the term of this patent is extended or adjusted under 35 U.S.C. 154(b) by 0 days.

(21) Appl. No.: 09/530,816

(22) PCT Filed: Nov. 6, 1998

(86) PCT No.: PCT/AU98/00929

§ 371 (c)(1),
(2), (4) Date: Jul. 10, 2000

(87) PCT Pub. No.: WO99/24776

PCT Pub. Date: May 20, 1999

(30) Foreign Application Priority Data

Nov. 6, 1997 (AU) ..... PP 2016

(51) Int. Cl.[7] ..... F42B 3/00; F42B 3/18

(52) U.S. Cl. ..... 102/200; 102/200; 102/202.1; 102/202.2; 102/301

(58) Field of Search ..... 102/202.1, 202.2, 102/200, 206, 221, 301

(56) References Cited

U.S. PATENT DOCUMENTS

| | | | | |
|---|---|---|---|---|
| 1,189,011 | A | 6/1916 | Smith | |
| 2,725,821 | A | 12/1955 | Coleman | 102/22 |
| 2,759,417 | A | 8/1956 | O'Neill | 102/20 |
| 2,980,019 | A | 4/1961 | Noddin | 102/28 |

(List continued on next page.)

FOREIGN PATENT DOCUMENTS

| | | | |
|---|---|---|---|
| DE | 911896 | 11/1962 | |
| GB | 2 200 977 A | 8/1988 | C06C/5/06 |
| HU | 171229 | 6/1978 | |
| HU | 166283 | 9/1978 | |
| HU | 178433 | 12/1983 | |
| WO | WO 95/28551 | 10/1995 | |

OTHER PUBLICATIONS

RocKracker from RockTek USA Ltd.; Shooting Oversize Couldn't be Easier!.
RocKracker; The Simple Rockbreaking System from Rock-Tek USA Ltd.
daveyfire inc.; Product Reference System; 1–3.
daveyfire inc.; N Series Fusehead; 1–7.
daveyfire inc.; Home Product Reference System Initiation Devices; 1–4.
Persson et al.; 1993; Rock Blasting and Explosives Engineering; 56 and 400–401.
Product advertisement "Boulder Buster" 2 pages.

*Primary Examiner*—Michael J. Carone
*Assistant Examiner*—Lulit Semunegus
(74) *Attorney, Agent, or Firm*—Sheridan Ross P.C.

(57) ABSTRACT

The controlled electromagnetic induction detonation system for initiation of a detonatable material system includes an automated radio charge (ARCH) module connectable to an electric detonator, a transducer module for providing operational power by electromagnetic induction to the ARCH module, and a remote controller for sending instructions to the transducer module from a location remote from the detonator. Upon completion of an arming sequence, the transducer module generates an electromagnetic field which is picked up by a coil in the ARCH module and used to power the ARCH module and provide a detonation current for the detonator. The transducer module or at least a coil thereof which produces the electromagnetic field is supported on or in a stemming bar which in turn acts as a core of an electromagnet confining the magnetic flux for pick up by the ARCH module. Multilevel access control and interlock systems operate between the remote controller, transducer unit and the ARCH module to reduce the likelihood of unintentional initiation of the detonator.

37 Claims, 9 Drawing Sheets

U.S. PATENT DOCUMENTS 3,003,419 A 10/1961 Fite ..... 102/86.5
3,134,329 A 5/1964 Zeman ..... 102/28
3,144,827 A 8/1964 Boutwell ..... 102/39
3,264,990 A 8/1966 Betts ..... 102/28
3,264,991 A 8/1966 Betts et al. ..... 102/28
3,272,127 A 9/1966 Betts et al. ..... 102/70.2
3,307,445 A 3/1967 Stadler et al. ..... 86/20
3,313,234 A 4/1967 Mohaupt ..... 102/20
3,604,355 A 9/1971 Greenlees ..... 102/39
3,640,223 A 2/1972 Olsson ..... 102/28
3,735,704 A * 5/1973 Livingston
3,999,484 A 12/1976 Evans ..... 102/28 R
4,040,355 A 8/1977 Hopler, Jr. ..... 102/22 R
4,165,690 A 8/1979 Abrahams ..... 102/22 R
4,208,966 A 6/1980 Hart ..... 102/20
4,419,153 A 12/1983 Boberg ..... 149/22
4,470,352 A 9/1984 Leperre ..... 102/333
4,615,268 A * 10/1986 Nakano et al. ..... 102/200
4,632,034 A 12/1986 Colle, Jr. ..... 102/312
4,669,383 A 6/1987 Penner ..... 102/202
4,674,047 A * 6/1987 Tyler et al. ..... 102/200
4,685,396 A 8/1987 Birse et al. ..... 102/206
4,730,560 A 3/1988 Bartholomew et al. .. 102/275.3
4,742,773 A 5/1988 Bartholomew et al. .. 102/275.3
4,754,705 A 7/1988 Worsey ..... 102/333
4,756,250 A 7/1988 Dias dos Santos ..... 102/275.1
4,757,764 A 7/1988 Thureson et al. ..... 102/312
4,809,612 A 3/1989 Ballreich et al. ..... 102/466
4,869,171 A 9/1989 Abouav ..... 102/215
4,884,506 A 12/1989 Guerreri ..... 102/200
4,886,126 A 12/1989 Yates, Jr. ..... 175/4.54
RE33,202 E 4/1990 Janoski ..... 102/202.3
4,986,183 A * 1/1991 Jacob et al. ..... 102/200
5,000,516 A 3/1991 Kolle et al. ..... 299/16
5,014,622 A * 5/1991 Jullian ..... 102/312
5,031,538 A 7/1991 Dufrane et al. ..... 102/275.5
5,033,390 A 7/1991 Minert et al. ..... 102/530
5,038,682 A * 8/1991 Marsden ..... 102/217
5,052,301 A 10/1991 Walker ..... 102/202.7
5,069,130 A 12/1991 Buckley et al. ..... 102/202
5,088,412 A 2/1992 Patrichi ..... 102/202.13
5,090,321 A 2/1992 Abouav ..... 102/200
5,098,163 A 3/1992 Young, III ..... 299/13
5,117,756 A * 6/1992 Goffin, II ..... 102/217
5,247,886 A 9/1993 Worsey ..... 102/312
5,253,586 A 10/1993 Worsey ..... 102/313
5,308,149 A 5/1994 Watson et al. ..... 299/13
5,452,661 A 9/1995 Neff ..... 102/202.7
5,460,093 A * 10/1995 Prinz et al. ..... 102/217
5,474,364 A 12/1995 Ruzzi et al. ..... 299/13
5,520,114 A * 5/1996 Guimard et al. ..... 102/206
5,573,307 A 11/1996 Wilkinson et al. ..... 299/14
5,611,605 A 3/1997 McCarthy ..... 299/13
5,710,390 A 1/1998 Ofca ..... 102/275.4
5,714,712 A 2/1998 Ewick et al. ..... 102/311
5,765,923 A 6/1998 Watson et al. ..... 299/13
5,789,694 A 8/1998 Mey ..... 86/20.15
5,803,550 A 9/1998 Watson et al. ..... 299/13
5,803,551 A 9/1998 McCarthy ..... 299/13
5,844,322 A 12/1998 Andersson et al. ..... 264/3.3
5,894,103 A * 4/1999 Shann ..... 102/217
6,006,671 A 12/1999 Yunan ..... 102/275.11
6,014,932 A * 1/2000 Mardirossian ..... 102/200
6,021,095 A * 2/2000 Tubel et al.
6,035,784 A * 3/2000 Watson
6,102,484 A * 8/2000 Young, III
6,145,933 A * 11/2000 Watson et al.
6,148,730 A 11/2000 Watson ..... 102/313
6,173,651 B1 * 1/2001 Pathe et al. ..... 102/200

* cited by examiner

CONTROLLED ELECTROMAGNETIC INDUCTION DETONATION SYSTEM FOR INITIATION OF A DETONATABLE MATERIAL

CROSS REFERENCE TO RELATED APPLICATIONS

This application claims priority, under 35 U.S.C. § 365 (a), to PCT Patent Application Ser. No. PCT/AU98/00929, filed on Nov. 6, 1998, and published in English on May 20, 1999 as WO 99/24776, which claims priority to Australian Patent Application Ser. No. PP 2016, filed on Nov. 6, 1997 the entirety of which are incorporated herein by reference.

FIELD OF THE INVENTION

The present invention relates to a controlled electromagnetic induction detonation system for initiation of a detonatable material, and in particular, but not exclusively, for decoupled in-hole initiation of a detonatable material.

BACKGROUND OF THE INVENTION

Throughout this specification and claims the term "detonatable material" is used in a broad and generic sense to include any initiating device such as an electrical detonator, fuse, fusehead, electric match; and, any energetic material such as explosive, propellant and the like.

Explosives and propellants are used in the mining and construction industries in many different applications including tunnelling, stoping, civil excavations and boulder breaking.

In order to initiate the explosive or propellant some type of detonator or fuse is required. The detonator or fuse in turn can be set off either electrically or mechanically. The present invention is concerned with the wireless electric initiation of a detonator or fuse or other energetic material.

Most commonly, the initiating of an electric detonator or fuse is accomplished by a physical conductor such as a wire pair connected at one end to the detonator and at an opposite end to an electric power supply via a switch. When the switch is closed, current flows through the wire to initiate the detonator or fuse.

Such type of electric initiation system can sometimes be set off prematurely or accidentally through the induction of electric currents in the conductors by stray electromagnetic fields or, through faults in the initiating electric circuit comprising the wires, switch and power supply.

Another electric initiation system available under the brand name Magne-Det is known in which a pair of electric conductors that are attached to a detonator extend through a coil through which a current flows. The current flowing through the coil induces a current to flow through the conductors which in turn is used as the detonation current. However this system is also clearly prone to accidental or premature activation by picking up stray electromagnetic fields.

All of these initiation systems require manual connection of the detonator to a source of initiation energy.

SUMMARY OF THE INVENTION

It is the object of the present invention to provide a detonation system in which the likelihood of accidental initiation of a detonatable material is substantially reduced. It is a further object of the present invention to provide a system for wireless non-contact initiation of a detonatable material.

According to the first aspect of the present invention there is provided a controlled electromagnetic induction detonation system for initiating a detonatable material, the system including:

an automated radio charge (ARCH) module for delivering an electric detonation current to a detonatable material, said ARCH module having no permanent on board power supply including a power circuit for extracting power by means of electromagnetic induction from a electromagnetic field generated remotely from the ARCH module, the power circuit providing operational power for the ARCH module and the electric detonation current, and means for receiving and decoding radio transmitted control signals including a FIRE code, the verified receipt of which causes the ARCH module to deliver said current to and thereby initiate the detonatable material.

Preferably the means for receiving and decoding the control signal extracts the control signal from said electromagnetic field.

Preferably said control signal includes an ARM code and the means for receiving and decoding, upon receipt, decoding and verification of said ARM code, initiates a timer in said ARCH module to time a predetermined period in which said ARCH module must receive, decode and verify said FIRE code in order to deliver said detonation current to the detonatable material, and in the absence of which, said ARCH module automatically shuts down for a second predetermined period.

Preferably said ARCH module further includes an output switch through which said electronic detonation current must flow in order to initiate the detonatable material, said switch configured to provide a short circuit output to the detonatable material until receipt and verification of said FIRE code, in which instance, said switch is operated to remove said short circuit and allow the electronic detonation current to flow to the detonatable material.

Preferably said system further includes a transducer unit having a power supply for supplying power to electromagnetic field generating means for generating said electromagnetic field and radio transceiver means for radio transmitting said control signals to the ARCH module.

Preferably said transducer unit further includes means for impressing said control signals onto said electromagnetic field so that said radio transceiver means transmits both said electromagnetic field and said control signals to said ARCH module.

Preferably said transducer unit includes a mode switch switchable between a LOCAL mode and a REMOTE mode of operation, wherein in said LOCAL mode of operation, a user can manually input instructions to said transducer unit for radio transmission to said ARCH module and wherein in said REMOTE mode of operation, a user can input instructions to said transducer unit via a remote controller unit.

Preferably said transducer unit includes means for manual entry of instructions and a timer means both operationally associated with said mode switch whereby on switching said mode switch to the LOCAL mode, a user must enter via said entry means a valid identification number recognised by said transducer unit within a predetermined period of time timed by said timer means in order for further user instructions to be acted upon by said transducer unit, and in the absence of the entry of a valid identification number within said time period said transducer unit automatically shuts down so as to be non responsive to user input instructions for a second period of time timed by said timer means.

Preferably said transducer unit includes an ARM switch functional when said transducer unit is in the LOCAL mode of operation which, when activated causes said electric field generating means to generate said electromagnetic field.

Preferably said transducer unit includes a FIRE switch functional when said transducer unit is in the LOCAL mode of operation and which when activated within a predetermined time period after activation of the ARM switch causes the transducer unit to transmit the FIRE code to the ARCH module.

Preferably said system further includes a stemming bar for stemming a hole in which said ARCH module and detonator can be deposited and wherein said transducer unit includes a coil for generating said electromagnetic field, said coil mounted on or in the stemming bar so that lines of magnetic flux pass through the stemming bar and link with the power circuit to transfer operational power to the ARCH module by electromagnetic induction.

Advantageously the stemming bar is reusable.

Preferably said system further includes a remote controller unit by which a user can communicate instructions to said transducer unit from a location remote from said transducer unit.

Preferably said remote controller unit includes means for the manual entry of instructions by which a user must enter a valid identification number within a predetermined time period in order for said remote controller to establish a radio communication link with said transducer unit. Although in an alternate embodiment the remote controller can be key-switch operated.

Preferably said remote controller unit includes processor means for generating a unique identification code word which is continuously transmitted until an acknowledgment signal is received from said transducer unit corresponding to said identification code word, and wherein in the absence of receipt of said acknowledge signal within a predetermined time period said remote controller unit enters a RESET mode in which a user must once again enter a valid identification number to reinitiate the establishment of the radio communication link with said transducer unit. Preferably said remote controller unit further includes an ARM switch which upon activation, when a radio communication link has been established with said transducer unit, causes the remote controller unit to transmit an ARM code to transducer unit upon which said transducer unit generates said electromagnetic field. However in an alternative embodiment the remote controller can be hard-wired to the transducer unit.

Preferably the ARM code is transmitted by said remote controller to said transducer unit is different to the ARM code sent by said transducer unit to said ARCH module.

Preferably said transducer unit sends an acknowledgment signal to said remote controller unit upon receipt of the ARM code and said transducer unit thereafter initiates its timer means to time a first period within which to receive a FIRE code from said remote controller unit, wherein the absence of receipt of said FIRE code within said first period said transducer unit automatically shuts down for a second period of time.

Preferably said remote control unit includes a FIRE switch, which, when activated causes the remote control unit to transmit a FIRE code to said transducer unit which in turn upon on verified receipt thereof retransmits the FIRE code to said ARCH module.

Preferably the FIRE code transmitted by the remote controller to transducer unit is different to the FIRE code retransmitted by the transducer unit to the ARCH module.

According to another aspect of the present invention there is provided a controlled electromagnetic induction detonation system for decoupled in-hole initiation of an detonatable material, said system including:

an automated radio charge (ARCH) module coupled to a detonatable material and deposited in a hole formed in a hard material, the ARCH module having no permanent on board power supply but including a power circuit for extracting by means of electromagnetic induction operational power from a remotely generated electromagnetic field, the power circuit providing operational power for the ARCH module and arranged to generate a detonation current deliverable to the detonatable material, and means for receiving and decoding radio transmitted control signals including a FIRE code, the verified receipt of which causes delivery of the detonation current to the detonatable material;

a stemming bar for stemming the hole in which the energetic material and ARCH module are deposited; and, a transducer unit for radio transmitting said control signals, said transducer unit having a coil for generating the electromagnetic field, the coil mounted on or in the stemming bar to effect the transfer of operational power to the ARCH module by electromagnetic induction.

BRIEF DESCRIPTION OF THE DRAWINGS

An embodiment of the present invention will now be described by way of example only with reference to the accompanying drawings in which.

DETAILED DESCRIPTION OF THE PREFERRED EMBODIMENTS

Figure 1:
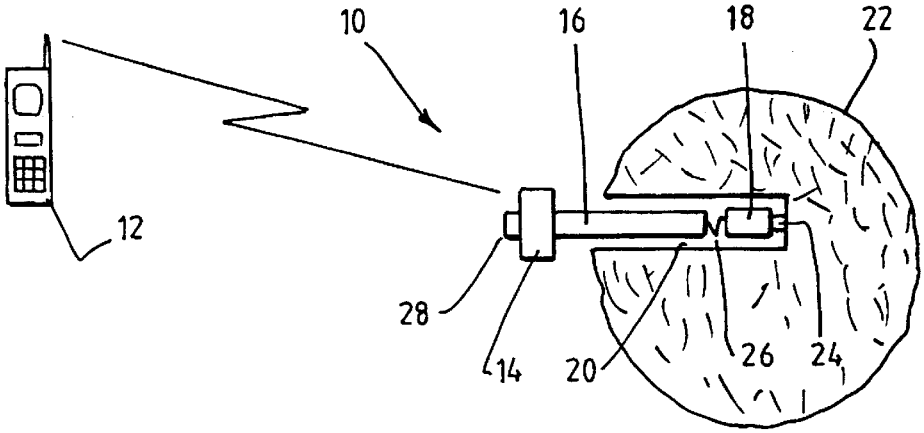
FIG. 1 is a schematic representation of one embodiment of the controlled electromagnetic induction detonation system for initiating an energetic substance.

From FIG. 1 it can be seen that one embodiment of the controlled electromagnetic induction detonation system 10 includes the following separate but interacting components: a remote controller 12, a transducer unit 14; a stemming bar 16; and, an automated radio charge (ARCH) module 18, although as will be apparent not all of these components are necessary in every embodiment of the invention.

When the system 10 is used for in situ excavation or fragmenting a boulder 22 a hole 20 is first drilled into the boulder 22. The ARCH module 18 together with a coupled detonator 24 is pushed to the bottom of the hole 20 by the stemming bar 16. The ARCH module 18 is typically spaced from or otherwise not directly attached to the proximal end of the stemming bar by an air gap 26. In this way the ARCH module 18 is physically decoupled from the stemming bar 16. The stemming bar 16 is dimensioned so that an end 28 distant the ARCH module 18 extends from the hole 20. Located about end 28 is the transducer unit 14 or at least a coil/antenna of the transducer unit 14.

The remote controller 12 can be located anywhere within the radio range of the transducer unit 14. In general terms, the remote controller 12 is operated to transmit instructions to the transducer unit 14 that in turn sends instruction and operating power to the ARCH module 18 from a location remote from the ARCH module 18 for the subsequent initiation of the detonator 24. The instructions from the remote controller 12 are sent from a safe location distant the detonator 24. The instructions sent include ARM and FIRE codes. The transducer module 14 upon receipt of the ARM codes operates to generate an electromagnetic field and to retransmit the ARM code typically in a different format say ARM-1, to the ARCH module 18. Advantageously, the ARM-1 code is impressed onto the electromagnetic field. The transducer unit 14 then waits to receive the FIRE code from the remote controller 12. If the FIRE code is received within a predetermined time period it is retransmitted in a different format, say FIRE-1, to the ARCH module 18 by being impressed on the induced electromagnetic field.

The ARCH module 18 does not have an onboard, nor is hard wired to a permanent power supply. Rather, as will be explained in great detail below, the ARCH module 18 includes circuits for extracting its operational power from the electromagnetic field generated remotely by the transducer unit 14. Additionally, the ARCH module 18 upon receipt and internal verification and checking of the ARM-1 and FIRE-1 codes from the transducer module 14 can then produce and deliver an electric detonation current to the detonator 24.

Figure 2:
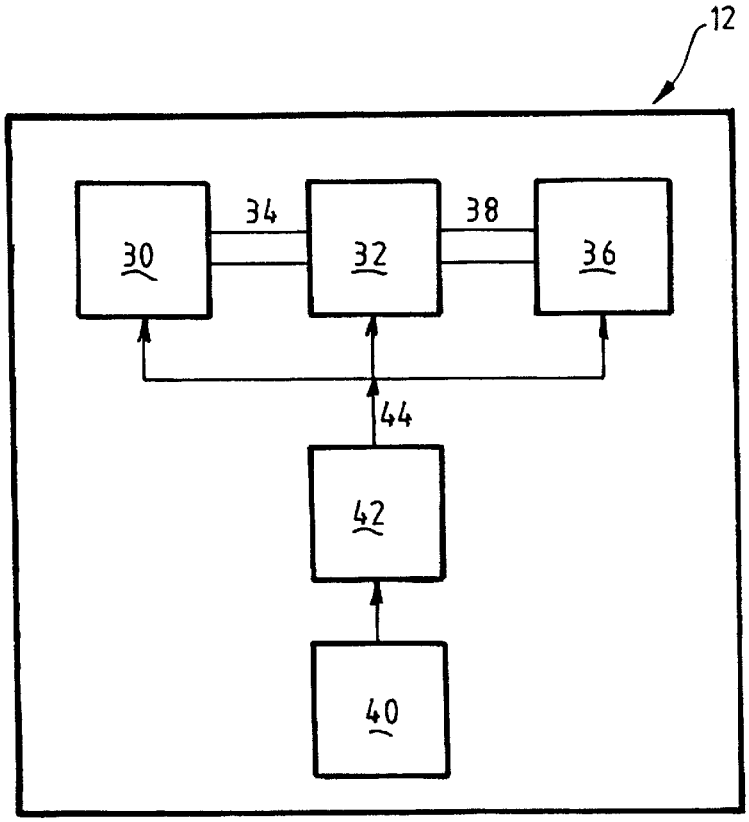
FIG. 2 is a block diagram of a remote controller of the system.

Referring to FIG. 2, the remote controller 12 is provided with a keypad and interface unit 30 by which information and instructions can be input. Signals can be transferred between the keypad and interface unit 30 to a micro controller 32 via a communication bus 34. The micro controller in turn can communication with a FSK transceiver and antenna 36 via communication bus 38. Electrical power from a rechargeable battery 40 is input to a power supply circuit 42 which delivers operating electrical power to the keypad 30, micro controller 32 and FSK transceiver 36 via power rail 44.

The hardware components of the controller 12 namely, the keypad 30, micro controller 32, FSK transceiver and antenna 36 and power supply circuit 42 are either standard off-the-shelf components or constructed in accordance with normal hardware design practice. In this regard, the micro controller 32 includes a micro processor with both a RAM and ROM and an address decoder etc. The specific functionality of the remote controller 12 is derived from its dedicated software.

Figure 5:
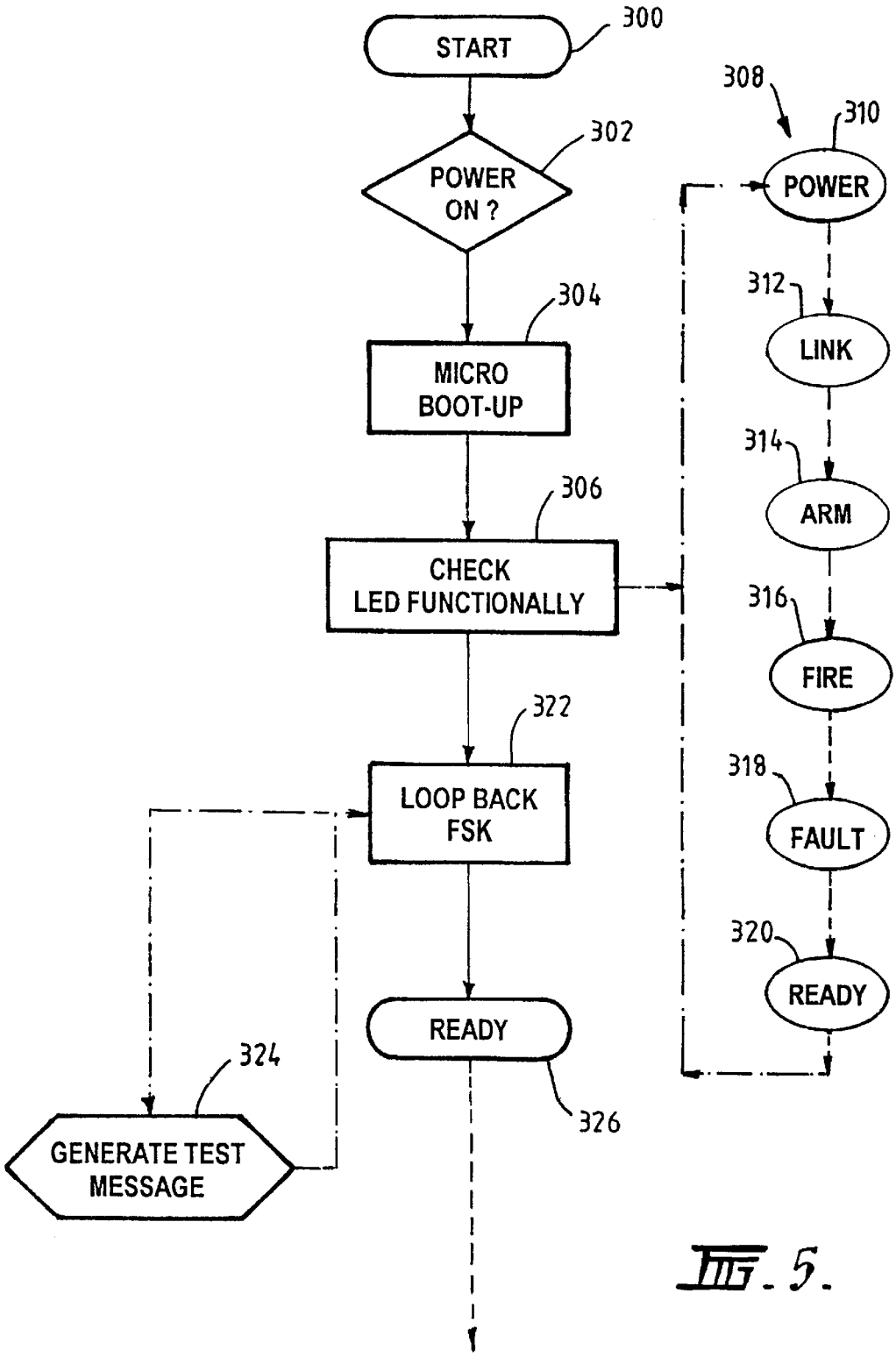
FIGS. 5, 6 and 7 when joined end to end for a state diagram describing the operation of the remote controller shown in FIG. 2.
Figure 6:
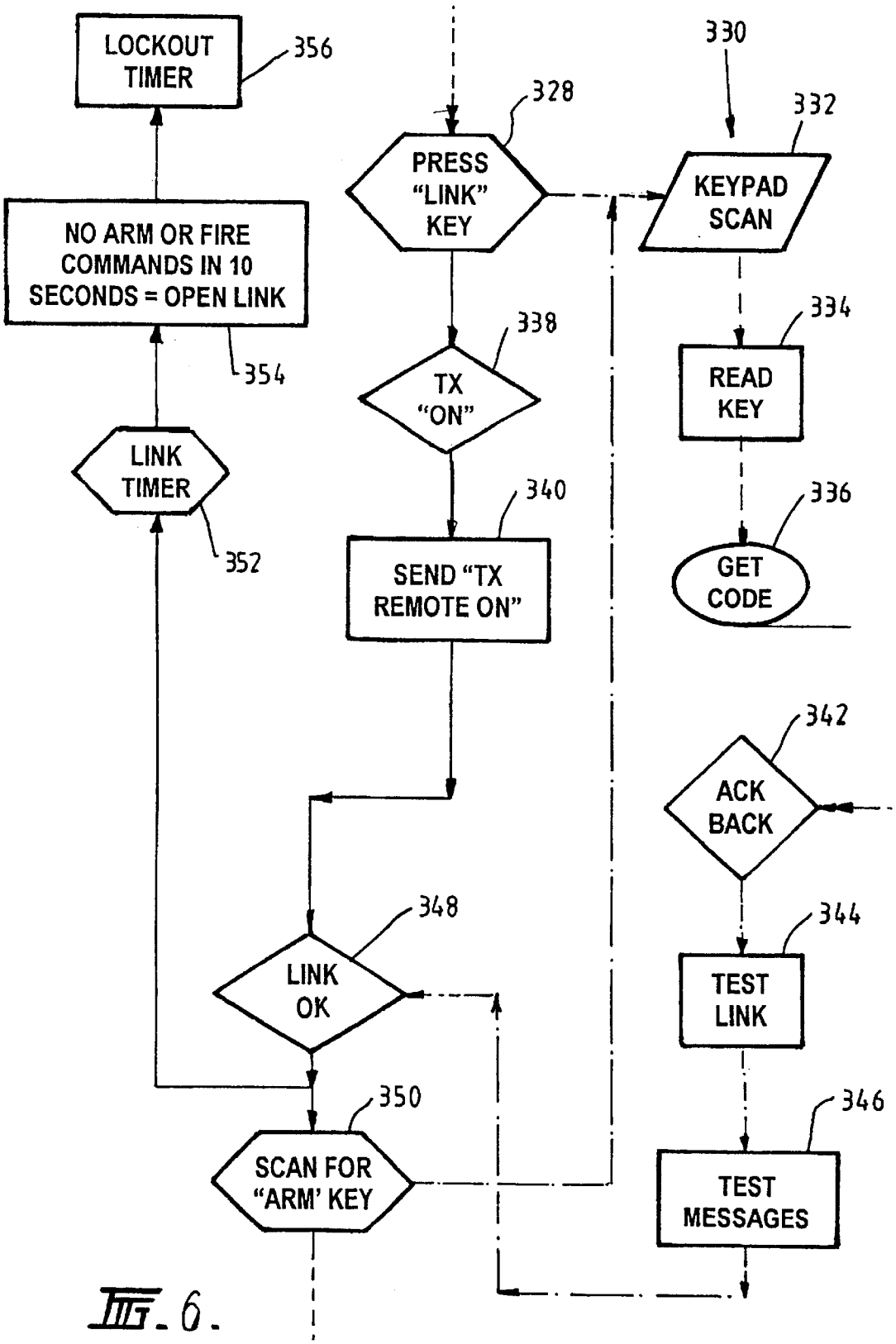
Figure 7:
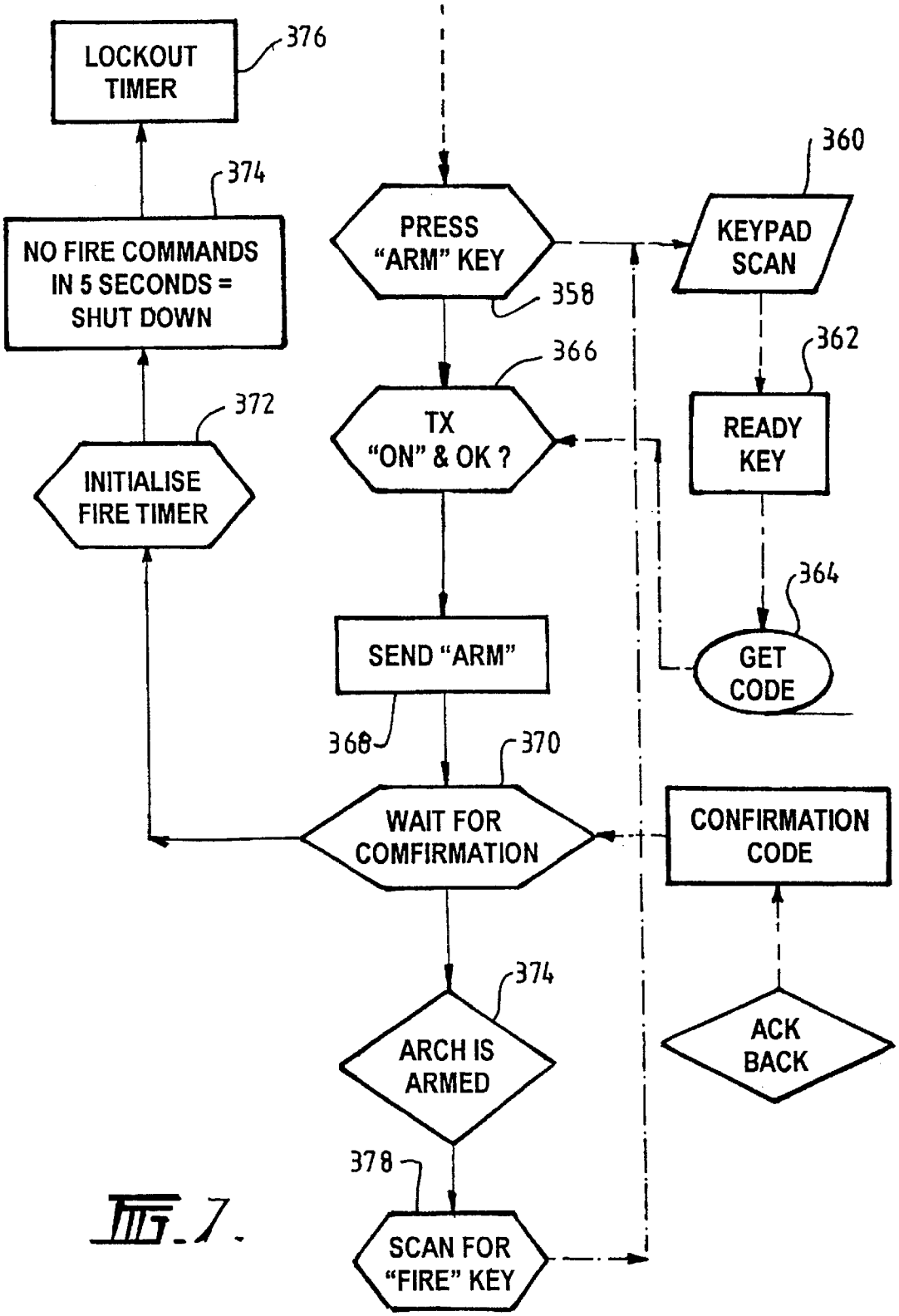

The modus operandi of the remote controller 12 is depicted in the state diagrams of FIGS. 5, 6 and 7. Specifically, FIG. 5 illustrates the POWER-UP routine for the remote controller 12. State 300 simply indicates the start of the POWER-UP routine. State 302 indicates that the power to the remote controller 12 is turned on. This typically would occur on the flicking of a ON/OFF switch (not shown). After the power on state 302, the micro controller 32 is booted at state 304. Next, in state 306 a LED functionality check is performed. This step involves sequencing through a subroutine 308 to check that the LED indicators for the status of various conditions or states are operational. The conditions and states tested are the power state 310 indicating that the remote controller 12 is powered; the LINK state 312 indicating that a radio communication link has been established between the remote controller 12 and the transducer module 14; the ARM state 314 indicating that an ARCH module 18 is armed; the FIRE state 316 indicating that the FIRE code has been sent by the remote controller 12 to the ARCH module 18 via the transducer module 14; a FAULT state 318 indicative of a fault in the system 10 and the READY state 320 indicative that the remote controller 12 is ready to receive commands via its keypad and interface unit 30.

The next state entered in the POWER-UP routine is the loop back FSK state 322. When in this state, the remote controller 12 causes its FSK transceiver 36 to generate a test message at step 324 which is sent back to itself and checked to ensure correct coding and decoding of the FSK signals sent and by the remote controller 12. If this tests detects no fault, the remote controller 12 enters the READY state 326 which is accompanied by the illumination of a READY LED on the remote controller. At this state, the remote controller 12 is simply waiting for the next instruction via the keypad and interface unit 30.

Referring to FIG. 6, the remote controller next enters an ESTABLISH LINK routine upon activation of a LINK key on the keypad 30, indicated as state 328. The purpose of the ESTABLISH LINK routine is to establish a link, ie radio communication, with the transducer module 14. The pressing of the LINK key on the keypad 30, is detected and acted upon by subroutine 330 which instructs the controller 32 at step 332 to scan the keyboard 30- and at step 334 to read the pressed key. Assuming that the key is the LINK key a corresponding LINK code is fetched from the memory section of micro controller 32 at state 336, and then used to modulate an oscillator to produce a FSK signal which is communicated by bus 38 to the transceiver 36.

The transceiver 36 is turned ON as indicated at state 338 and the LINK code sent at step 340, by the transmitter 36 to the transceiver module 14. Assuming that the LINK code is received by the transducer module 14, and is correctly decoded, the transducer module 14 transmits an acknowledgment back, (ACK BACK) code to the remote controller 12 as indicated at step 342. The ACK BACK code is then processed at step 344 and various test messages generated in state 344 indicative of the LINK test results. Assuming that the link between the remote controller 12 and transceiver module 14 is functioning to a predetermined reliability, a radio link will be established as indicated at state 348.

Once the radio link is established, the remote controller 12 at routine 350 scans the keyboard 30 for depression of the ARM key, and at step 352 starts a timer. The timer counts a period set in step 354, which can be adjusted but is shown as a nominal 10 second period. The remote controller 12 remains in the scan state 350 unit the expiration of the period set in state 354. If the ARM key is not activated within this period the radio link to the transducer unit 14 is disconnected and lock out timer is initiated at state 356 which prohibits the reestablishment of the radio link with the transducer module 14 for a predetermined period of time for example five minutes. If, during the period in state 354, the ARM key is pressed an ARM routine shown in FIG. 7 is entered.

The pressing/activation of the ARM key is shown as state 358. The depressing of the ARM key is detected by the micro controller 12 scanning the keypad at state 360, reading the key pressed at state 362, and if the key is the ARM key, the micro controller 32 fetches an ARM code at state 364 from its memory. The code is converted to a FSK signal for transmission. At state 366 the micro controller 32 simply ensures that the transceiver 36 is ON and OK. Assuming this to be the case, the FSK signal containing the ARM code is transmitted at state 368 via the previously established LINK to the transducer module 14. The remote controller 12 then waits at state 370 for confirmation of receipt of the ARM code from the transducer module 14. Upon receipt of confirmation the remove controller 12 simultaneously initiates a FIRE timer at state 372 and arms the ARCH module 18 at state 374. At state 374, the FIRE timer counts down a nominal period, say five seconds within which the FIRE key on the keypad 30 must be depressed in order to fire (ie initiate) the detonator 24. If this does not occur within the predetermined time period, then the remote controller 32 shuts itself down at state 374 and initiates the same lockout time at state 376 preventing operation of the remote controller 12 for a nominal five minute period.

During the period set by the FIRE timer the micro controller 32 enters a FIRE scanning state 378 in which it scans the keypad 30 for pressing of the FIRE key. This is similar to the ARM key state 358, and involves the micro controller 12 scanning the key pad (state 360) reading the key pad (state 362) and getting a corresponding FIRE code (state 364) from its memory in the event that the activation of the FIRE key is detected. The FIRE code modulates an oscillator to produce a FSK signal for transmission. State 366 is then reentered, the transceiver 36 OKed and at state 368 the FSK signal containing the FIRE code is transmitted to the transducer module 14.

Figure 3:
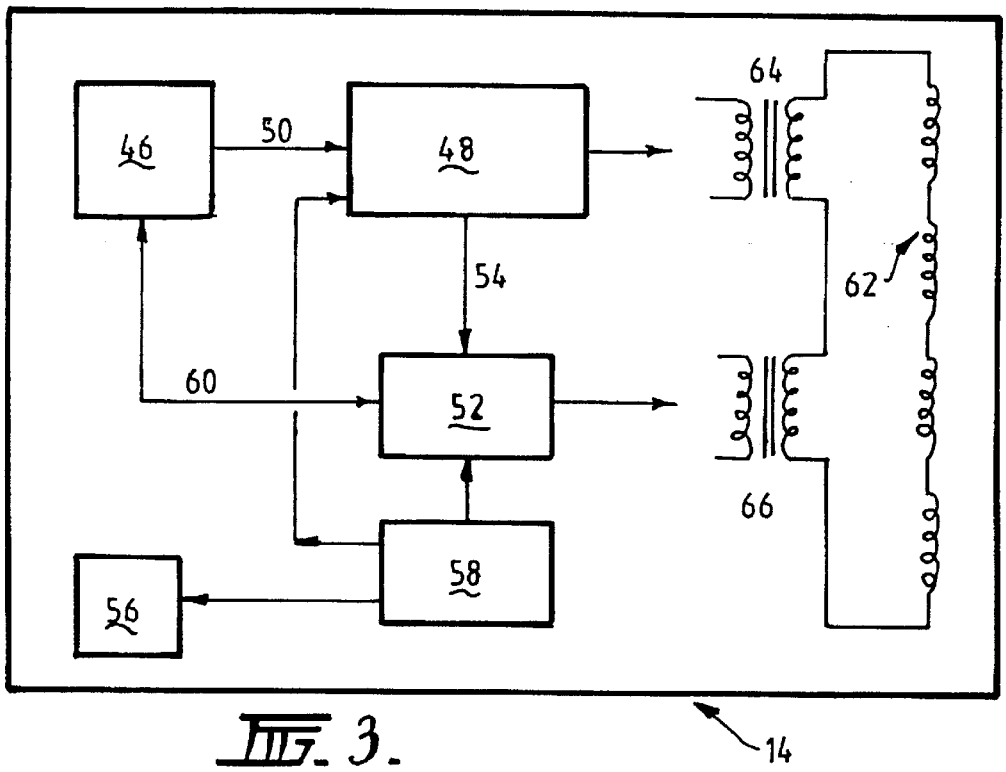
FIG. 3 is a block diagram of a transducer unit of the system.

FIG. 3 illustrates in block diagram form the configuration of a transducer module 14. The transducer module 14 includes a FSK transceiver 46 which communicates with a micro controller 48 via bus 50. Micro controller 48 also communicates with a chopper 52 via bus 54. A rechargeable battery 56 is included within the transceiver module 14 as its power source. The battery 56 is in electrical connection with a DC power supply circuit 58 which delivers power to the transceiver 46, micro controller 48, and chopper 52 via power rail 60. Also included within the transducer module 14 is a coil 62 for producing an electromagnetic field. Both the micro controller 48 and chopper 52 are inductively coupled to the coil 62 via respective inductive couplings 64 and 66.

In general terms, the transducer module 14 initiates the generation of specific frequency oscillations generated internally upon the receipt of encoded command signals from the remote controller 12. When certain commands are received and confirmed by its own transceiver 46 the micro controller 48 turns ON an oscillator and superimposes a series of digital code word instructions encoded as unique frequency shift keying (FSK) onto the oscillator. The micro controller 48 has several functions including:

Establishing a communications link with the remote controller.

Enabling the chopper 52 when it receives an ARM code or instruction from the remote controller 12. This provides operating power to the ARCH module 18 then sends control words to the ARCH module 18 after allowing time for power stabilisation.

Monitors the duration that the chopper 52 is turned ON and after a nominal period of 10 seconds switches the chopper 52 OFF, and sends a signal back to the remote controller 12 that the transducer module 14 is timed out. This prohibits a retry or reentry of further instructions for a programmable time period which normally would be in the order of five minutes.

Sends FIRE code to the ARCH module 18, and then shuts down the chopper 52.

Figure 9:
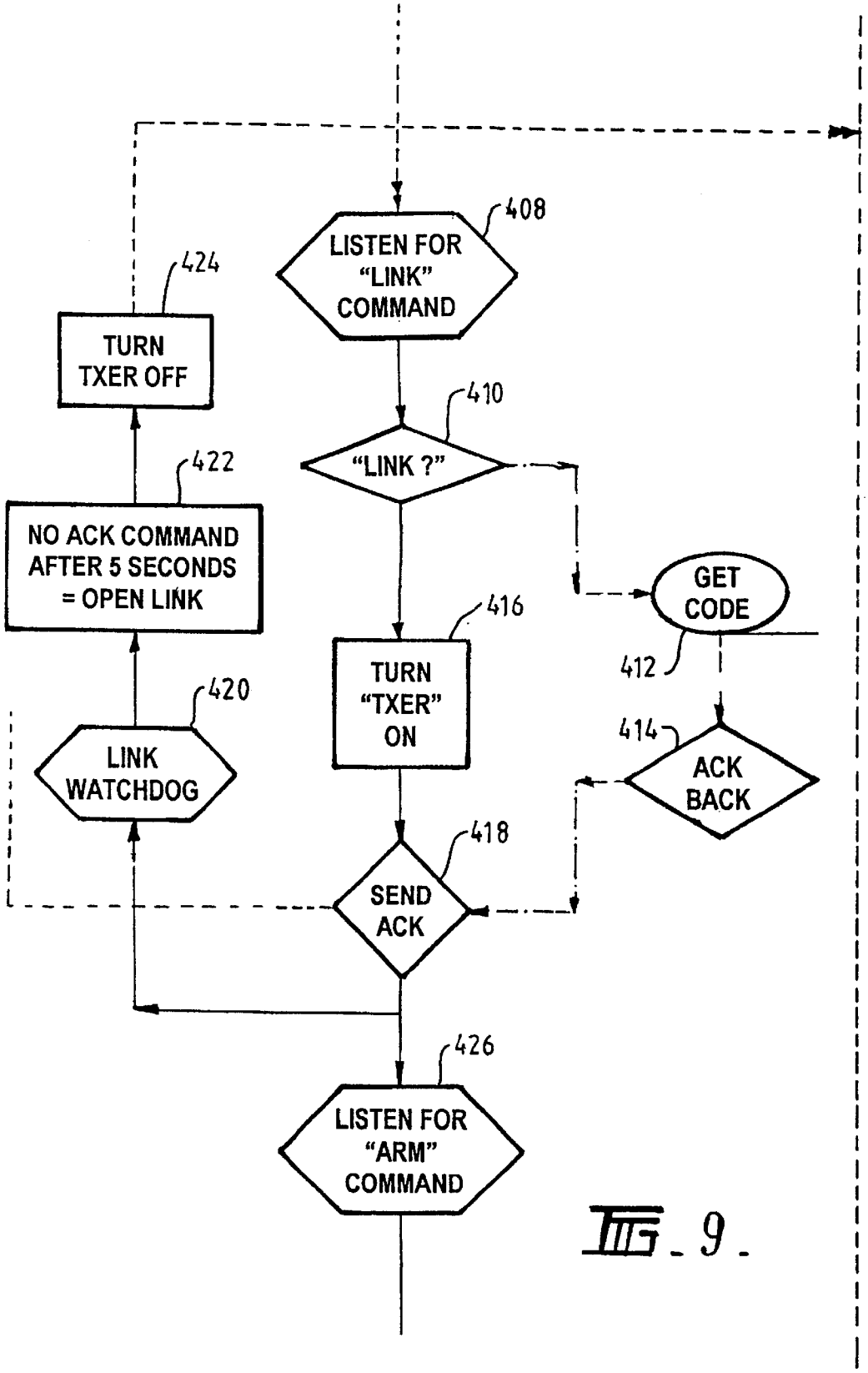
Figure 10:
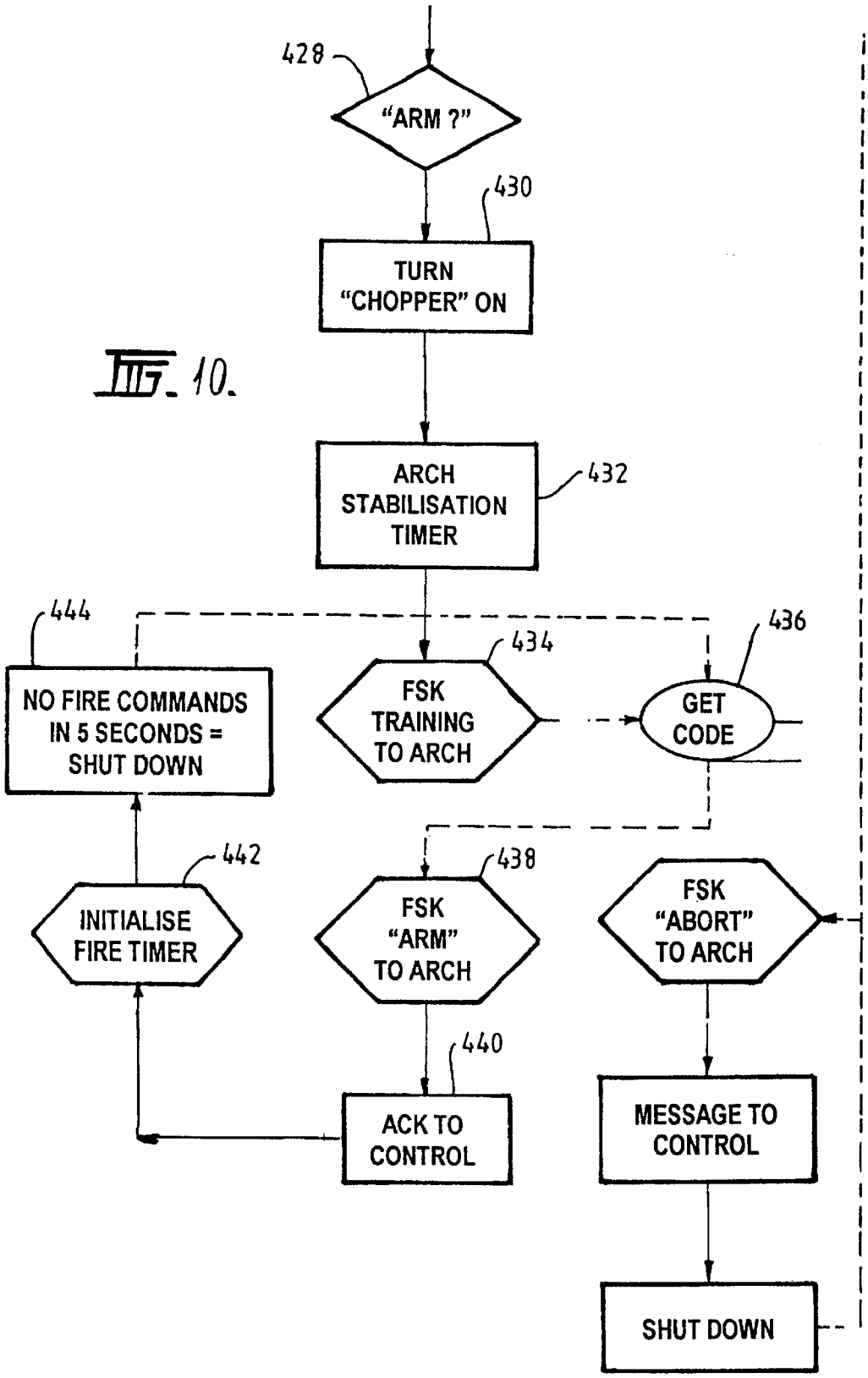

The transducer module regenerates its own control and initiation words once it receives the primary instructions from the remote controller 12. On receipt of the ARM code from the remote controller 12, the transducer module 14 will generate its own corresponding ARM-1 code. The same regeneration principle applies to the receipt of the FIRE code from the remote controller 12, with the regeneration of a FIRE-1 code. The operation of the transducer module is shown diagraphically in FIGS. 8–10.

Figure 8:
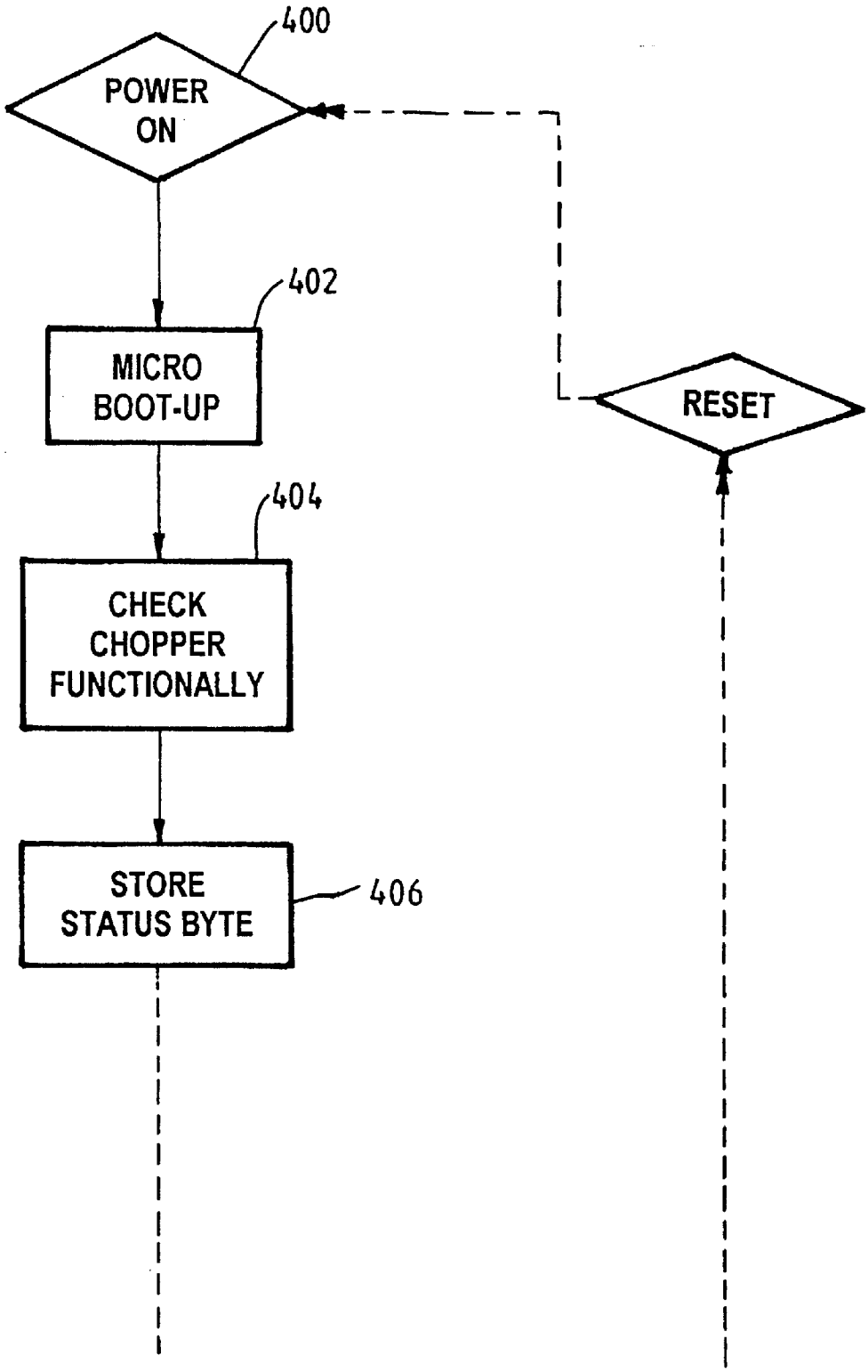
FIGS. 8, 9 and 10 when joined end to end form a state diagram for the operation of the transducer module shown in FIG. 3.

FIG. 8 illustrates the POWER-UP routine for the transducer module 14. The transducer module 14 has an internal power source, namely the battery 56 and therefore is initially in a power on state 400. Subsequent to the power on state 400, the micro controller 48 is booted at state 402. At state 404 a functionality test is conducted on the chopper 52. The status of the transducer module 14 is determined and a status byte is stored at state 406. The stored status byte is later sent back to the remote controller upon establishment of the communications link therewith so that the remote controller 12 can check the status of the transducer module 14.

Upon completion of the POWER-UP routine, the transducer module 14 enters a listening state 408 in which it awaits receipt of the LINK code from the remote controller 12. If receipt of the LINK code is detected at state 410, the transducer module 14 gets an appropriate response code from the memory of the micro controller 48 at state 412 and generates an acknowledgment back signal at state 414. Simultaneously, the transmitter portion to the transceiver 46 is turned ON at state 416 so that the acknowledgment back signal generated state 414 can be sent at state 418 back to the remote controller 12. It is this acknowledgment signal which is acted upon at states 342, 344, 346 and 348 in the ESTABLISH LINK routine of the remote controller 12. A link watchdog 420 also operates to ensure maintenance of the link between the remote controller 12 and transducer module 14. This is effected by watching at state 422 for the issuance of the acknowledgment signal from state 418 within a nominal predetermined time period such as five seconds. If no acknowledgment signal is sent at state 418 within five seconds of receipt of the LINK code at state 408 the transceiver 46 is turned OFF at state 424 effectively closing down the ESTABLISH LINK subroutine and resetting the state of the transducer module 14 to POWER ON state 400.

Assuming that the acknowledgment signal is received within the time period set at state 422, the transducer module 14 enters state 426 at which it listens for the ARM code or command from the remote controller 12. This commences the ARM routine shown in FIG. 10. At state 428 the micro controller 48 interrogates signals received by the transceiver 46 to ascertain whether or not it contains the ARM code. This is achieved by decoding the FSK signals transmitted by the remote controller 12 and comparing the decoded signals with predetermined signals stored in a look up table in the memory of the micro controller 48. If the ARM code is received and verified the micro controller 48 turns ON the chopper 52 at state 438. The chopper 52 is of conventional construction and operates in the standard manner to produce an AC output from the DC power supply 58. This output is coupled by the inductive coupling 66 to the coil 62. In one embodiment, the coil 62 is wound around the end 28 of the stemming bar 16. Therefore, at the stemming bar 16 together with the coil 62, act as an electromagnet when the chopper 52 is operating. Corresponding lines of magnetic flux are substantially confined to the stemming bar 16, and as will be described in greater detail below, traverse the gap 26 and link with a pick up coil in the ARCH module 18 to induce an electrical current which provides power for the ARCH modules 18. However it is preferred that the coil 62 is actually mounted inside the stemming bar 16 at an end nearest the detonator 24 when the stemming bar 16 is in the hole 20. This will minimise energy loss and maximise the inductive coupling and energy transfer to the ARCH module 18. In this variation lead wires pass through the stemming bar and connect the coil 62 to the remainder of the transducer unit 14.

Since the ARCH module 18 does not have its own on board permanent power supply, the transducer module 14 next enters a timer state 432 in which it allows sufficient time for power levels to be stabilised within the ARCH module 18. As a safely feature typically the remotely generated electromagnetic field would not carry sufficient instantaneous power to initiate the detonator 24. Therefore the ARCH module 18 would include electrical storage and integration circuits to accumulate over time the required power to operate the ARCH module and generate the necessary initiation current. After stabilisation, the transducer module 14 sends a FSK training signal at state 434 to the ARCH module 18.

The ARM-1 code is fetched from the memory of the micro controller 48 at state 436. The ARM-1 code is then used modulate an oscillator to produce an FSK signal which, at state 438 is output from the micro controller 48 and coupled to the coil 62 via inductive coupling 64, and thus transmitted to the ARCH module 18. That is, the lines of magnetic flux created by the current flowing through coil 62 provide not only operating power to the ARCH module 18 but also contain control signals including the arming code ARM-1 and firing code FIRE-1.

An acknowledgment signal is then sent back at state 440 to the remote controller 12 acknowledging receipt of the ARM code and the transmission of the ARM-1 code. This acknowledgment signal is waited for at state 370 in the ARM routine for the remote controller 12 shown in FIG. 7. Upon issuing of the acknowledgment signal the transducer module 14 initiates a FIRE timer at state 442, and at state 444 counts a predetermined shut down period, for example five seconds, within which to receive the FIRE code from the remote controller 12. If the FIRE code is not received within the predetermined time at state 444 the transducer module 14 shuts down. This of course turns OFF the chopper 52 thus cutting off power to the ARCH module 18.

If the FIRE code is received from the remote controller 12 within the predetermined period, the micro controller 48 fetches a FIRE-1 code from its memory which is different to the FIRE code sent by remote controller 12, uses that code to modulate an oscillator and produce an FSK signal which is coupled by inductive coupling 64 to the coil 62 and transmitted to the ARCH module 18.

Figure 4:
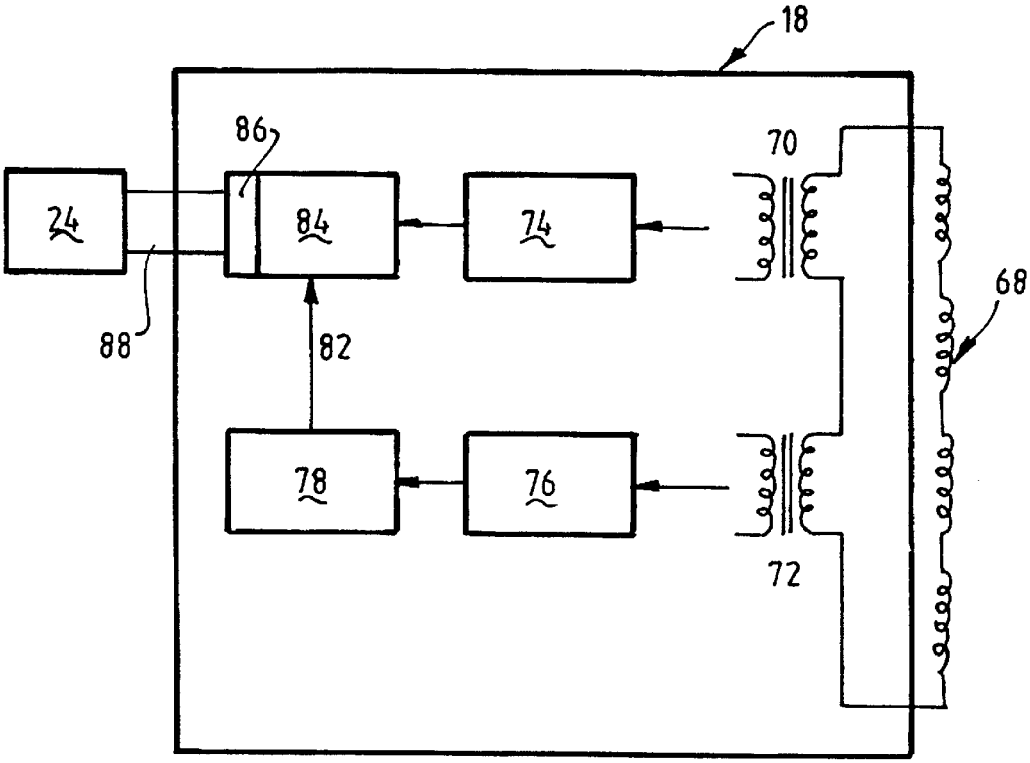
FIG. 4 is a block diagram of an automated radio charge module of the system.

Referring to FIG. 4, the ARCH module 18 comprises a pick up coil 68 which is positioned to link with the lines of magnetic flux passing through the stemming bar 16. The coil 68 also includes inductive output couplings 70 and 72. The output from coupling 70 is feed to a power supply 74 for powering the module 18 while the coupling 72 is input to an FSK receiver 76. The power supply 74 detects the induced electromagnetic field, and rectifies, integrates and uses the resulting DC voltage to charge an RC combination. The storage capacity of the onboard capacitor in the combination is sufficient to provide the working voltage and power requirements for the other onboard electronics as well as to provide the detonating current and voltage that is required to ignite detonator 24.

The FSK receiver 76 detects FSK signals that are being transmitted by the transceiver 46 of transducer module 14. As previously described, these FSK signals are superimposed on the induced electromagnetic field and magnetic flux lines. The input levels presented to the FSK receiver 76 may vary therefore it is desirable that this device includes an internal automatic level control (ALC). This ensures a constant signal level is presented to the receiver 76. As the FSK receiver 76 is powered by the onboard power supply it is desirable that this consume an absolute minimum of power and operate at as low a voltage as possible. FSK receiver produces a digital output which is coupled directly to a onboard micro controller 78. The micro controller 78 functions to monitor the digital word stream from the FSK receiver and look for appropriate commands words that it would expect to see from the remote controller (as regenerated and retransmitted by the transducer module 14).

The power supply 74 provides the micro controller 78 with a stabilised voltage supply thereby ensuring that it is not subject to the rise of the power supply as the voltage is induced in coil 68. On "power up" the micro controller 78 undertakes a series of status and housekeeping checks before allowing itself to listen for incoming instructions. The nature of these inhouse checks confirm that correct working volts are available and also the status and condition of its input and output control lines.

Once the micro controller 78 has been satisfied that it is operating correctly it then commences to listen out for control words transmitted from the remote controller 12 via the transducer module 14. In the overall timing of the system 10 once the transducer module 14 has produced the electromagnetic field via chopper 52, coil 62 and the stemming bar 16, the subsequent ARM-1 and FIRE-1 codes must be received within predetermined times frames as described above. If this does not occur the micro controller 78 will ignore all incoming signals and effectively go to sleep. The only way that the sequence can be reinitialised after this has occurred is to be powered down and repowered. This can be done by resetting the remote controller 12 and repeating the firing sequence.

When the transducer module 14 receives an ARM code from the remote controller 12 it energises its coil 62, waits for a period of time that corresponds with the settling time required by the ARCH power supply and inhouse ARCH micro checks (state 432), then sends its own internally generated ARM-1 code to the ARCH module 18. If the transducer module 14 does not receive the FIRE code from the remote controller 12 within a nominal time period after receiving the ARM code, then it will switch OFF the chopper 52 thereby removing power to the ARCH module 18. This proceeding sequence will result in the ARCH module 18 expecting to receive a FIRE-1 code from the transducer module 14 within a nominal five second window. If this does not occur then it is assumed that the transducer module 14 has not received the FIRE code from the remote controller 12 and therefore the micro controller 78 will shut down the ARCH module 18 and revert to a SLEEP mode.

When the micro controller 18 receives and decodes the FIRE-1 code from the transducer module 14, it initiates the detonation sequence. This is achieved by signally one or more of its output control lines 82 to a certain output state in turn allowing a logic array 84 to be triggered resulting in the energising of a firing switch or relay 86 that is connected to the detonator 24. The relay 86 is preferably a DPDT relay, with one set of contacts providing a permanent short circuit across leads 88 to the detonator 24. This ensures that no current can flow to the detonator 24 until the short circuit is removed by actuating the relay 86. This can only be down once the micro controller 78 processes the FIRE-1 command, and all other logic parameters and conditions have been satisfied. Typically this may involve the transmission of the FIRE-1 code by the transducer module 14 a predetermined number of times (say 30 times) and the correct decoding and checking of that signal by the receiver 76 and micro controller 78 on every instance.

When FIRE-1 code is received and all internal checks have been satisfied a detonating current is switched to the detonator leads 88 via the power supply 74 initiating or detonating the detonator 24.

Figure 11:
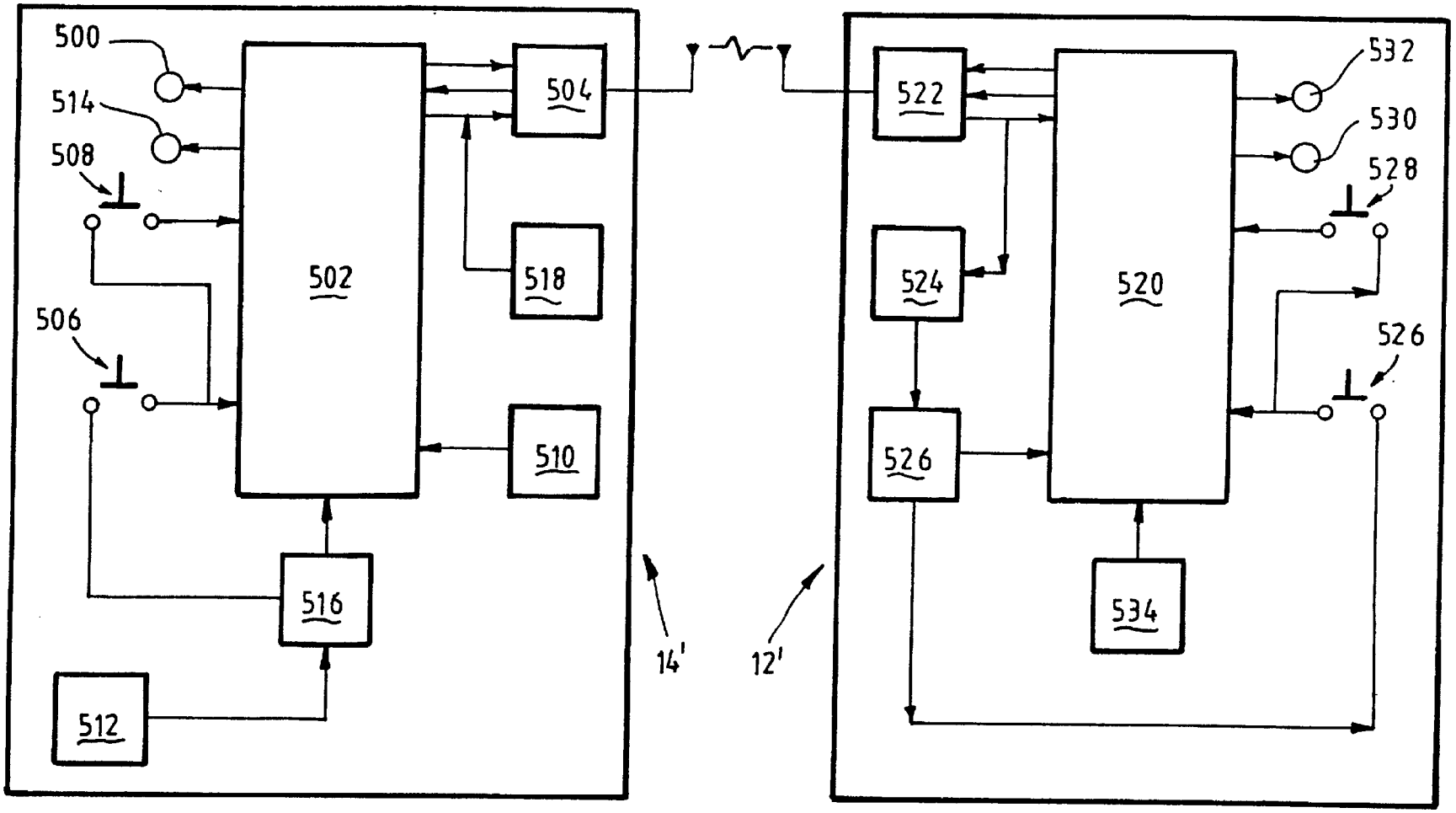
FIG. 11 is a block diagram of a second embodiment of a transducer unit and remote controller.

A second embodiment of the radio detonation system 10 is shown in FIG. 11. In the second embodiment, the ARCH module 18 is unchanged and therefore not shown in FIG. 11. The differences between the first and second embodiments lies in the configuration and operation of the remote control unit 12' and the transducer unit 14'. The essential difference which will be explained in great detail below, is that the transducer unit 14' can be placed in a LOCAL mode of operation allowing a user to manually enter various instructions and codes for transmission to the ARCH module. This therefore allows the user to set off the detonator 24 from say behind a piece of machinery or barrier via direct use of the transducer unit 14' instead of having to physically move a substantial distance away from the detonator 24 and use the remote controller to set off the charge 24. When the transducer unit 14' is in the REMOTE mode of operation then the remote control unit 12' can be used in essentially the same manner as remote controller 12 described herein above to set off the detonator 24.

When the transducer unit 14' is initially turned ON it automatically enters the REMOTE mode of operation and a REMOTE indicator 500 will illuminate. Watch keeping power is provided to microcontroller 502 and fail safe code generators. ARM and FIRE switches 506 and 508 respectively will have no effect until a user enters a valid personal identification number (PIN) via manual entry means such as a keypad 510 and mode switch 512 is switched to toggle the transducer unit 14' to the LOCAL mode. The main loop of the microcontroller 502 now enters a WAIT state and monitors for incoming commands and signals from the remote controller 12' and scans its keypad 510 and switches 506, 508 and 512.

It is possible to select the LOCAL mode of operation by switching the mode switch 512. Once this is done a number of events must occur and fail safe logic must be satisfied before the LOCAL mode is actually entered. Firstly, the REMOTE indicator 500 will remain illuminated, even though the MODE switch 512 has been switched to the LOCAL mode position. A LOCAL mode indicator 514 will illuminate after the authentication process has been successfully completed.

Once the mode switch 512 is activated, a time in a timer and logic system 516 will count down a predetermined period such as 10 seconds. Within this time, a user must enter a valid PIN via the keypad 510.

If a user enters a valid PIN number on the keypad 510 within a time limit counted by the timer unit 516 the REMOTE indicator 500 is extinguished and the LOCAL indicator 514 is illuminated. Also, an A1S generator 518 within the transducer unit 14' is activated. The A1S generator 518 generates an all 1's code or tone that is transmitted by the transceiver 504 to the remote controller unit 12'. The remote controller unit 12' is configured to ensure that it cannot be accessed or operated while it receives the all 1's tone from the transducer unit 14'.

In the event that an invalid PIN is entered by the keyboard 510 or no PIN is entered was not entered within the preset time period the microcontroller 502 is shut down for a second predetermined time period before which a user can again attempt to operate the transducer unit 14'. Valid PIN's can be stored in the microcontroller 502. It is envisaged that these PIN's can be changed or deleted at will.

When the transducer unit 14' is switched to the LOCAL mode and the ARM switch 506 is pushed or otherwise activated a DC voltage either onboard or controlled by the transducer unit 14' is switched to an inverter (ie chopper) to produce an AC voltage output that is routed via a stemming bar isolation switch (not shown) to a stemming bar coil (not shown but equivalent to coil 62 in FIG. 3) forming part of the transceiver 504. This generates the electromagnetic field for inducing operational power for the ARCH module 18. The transducer unit 14' and stemming bar coil are separate components connected by wires. In this way the coil can be placed about the stemming bar 20 and the transducer unit 14' operated from behind a piece of machinery or recoil device placed against the stemming bar 20. As with the previous embodiment, the ARM condition is held for a predetermined period of time that can be adjusted between 0 and 9 seconds. If the FIRE switch 508 is not activated or depressed within that period of time the transducer unit 14' disconnects power to the inverter (thereby starving the ARCH module at power) and shuts itself down for a predetermined period of time. If the FIRE switch 508 is activated within the provide time frame, the microcontroller 502 firstly validates or verifies the activation of the FIRE switch 508 and then generates a FIRE code in the form of a 128 bit datastream. This datastream is used to effectively modulate the output of the inverter causing it to operate as a pulse width modulation (PWM) source for the transceiver 504. The resulting PWM AC voltage provides both the power and signalling format required by the ARCH module 18.

The remote controller 12' can only be operated when the transducer unit 14' has been switched to the REMOTE mode of operation. If the transducer unit 14' is in the LOCAL operating mode an indicator lamp on the remote controller unit 12' will be illuminated and any switches, keypads or other input means on the remote controller unit 12' will be effectively disabled thereby denying the user to enter any commands into the remote control unit 12'. When power is first turned ON in the remote controller unit 12' watch keeping power is applied to its onboard microcontroller 520 as well as its transceiver 522 and A1S decoder 524. ARM and FIRE switches 526 and 528 respectively will have no effect until a LOCAL mode of operation of the remote control unit 12' has been established. Remote controller unit 12' includes a REMOTE mode indicator 530 and LOCAL mode indicator 532.

When the remote control unit 12' is turned ON and only when the transducer unit 14' has been switched to the REMOTE mode of operation, the LOCAL mode indicator 532 illuminates and the REMOTE mode indicator 530 extinguishes. The LOCAL mode indicator 532 will only illuminate after an authentication process has been successfully completed.

When the mode selector switch 512 on a transducer unit 14' is switched to REMOTE mode, 1.5 kHz tone (ie all 1's code) is generated via the A1S encoder 518 and transmitted by the transceiver 504. The transceiver 522 of the remote control unit 12' must receive and decode this tone before it can switch to the LOCAL operating mode. This is a fail safe system so that if the remote controller 12' is out of range of if the transducer unit 14' is in the LOCAL operating mode then it cannot be accessed.

Assuming all is in order and that the A1S decoder 524 decodes a valid tone, the A1S decoder 524 then initiates a timer in a logic and timer unit 526 to initiate the counting of a first time period normally of say 10 seconds. During this 10 second period an operator must enter a valid PIN via a keypad 534. If a PIN is not detected in this predetermined period of time or the PIN is not valid the microcontroller 520 will shut down for a second predetermined period of time before which it can be reactivated.

If a valid PIN has been entered and validated then the microcontroller 520 operates to establish a radio communication link with the transducer unit 14' in a similar manner as described in relation to the first embodiment. In broad general terms, the microcontroller 520 generates a unique identification code word (ie LINK code) and continuously sends the code word via its transceiver 522 until an acknowledgment is received from the transducer unit 14'. If no acknowledgment has been received after a set (but adjustable) period of time (say 60 seconds) then the microcontroller 520 enters a reset mode and the operator will again be prompted for a valid PIN. The main loop program for the microcontroller 520 is structured such that it will ignore any activity on its ARM/FIRE switches 526, 528 until such time as a radio communication link to the transducer unit 14' has been established. In the event that a radio communication link is established and an operator then pushes the ARM switch 526 an ARM code is sent via the transceiver 522 to the transducer unit 14'. The transducer 14' then executes its arming sequence however the transducer unit 14' must acknowledge receipt of the ARM code before the microcontroller 520 is enabled to proceed further. On receipt of valid acknowledgment from the transducer unit 14', a timer within the unit 526 is again operated to countdown a predetermined time adjustable between 0 and 9 seconds. In addition an ARMED indicator (not shown) is illuminated on the remote controller 12'. If the FIRE switch 528 is activated within the aforementioned time period, the microcontroller 520 will send a FIRE code via transceiver 522 to the transducer unit 14'. The FIRE code from the remote control unit 12' may typically be a 32 bit word. The transducer unit 14' must acknowledge receipt of the FIRE code from the transducer unit 12' and receive the same code a second time before the transducer unit 14' enters its firing cycle.

From the foregoing description it would be apparent that the system 10 can be used to initiate an electric detonator or electric match to enable detonation or rapid decomposition of an energetic material including an explosive or propellent-type material to occur within a previously drilled hole in a rock face or similar material requiring blasting or fragmentation. It is envisaged that a major application for the ARCH module 18 which has the potential to revolutionise hard rock drilling methods is in situ mining. In this regard, a custom designed machine can be made that can drill a hole or holes in a rock formation and automatically insert a ARCH module 18 and stemming bar 16 with transducer 14 or at least the transducer coil. The stemming bar can be reused (as of course can the transducer 14 and remote controller 12), the ARCH module 18 is however destroyed. Thus the machine would carry a supply of ARCH modules with attached detonators 24 for depositing into holes together with energetic material. More particularly, it is envisaged that the machine in question would typically have a boom that can be rotated about its longitudinal axis, with the boom supporting a drill for drilling holes in a rock formation; a delivery system for delivering or depositing an ARCH module 18 with attached detonator 24 and a charge of energetic material into the drilled hole; and, a ram for inserting and subsequently retracting the stemming bar 16 from the hole. The machine could be operated in essentially a continuous manner so that firstly a hole is drilled, the boom then rotated to align the delivery means with the hole to deposit an ARCH module 18 and detonator 24 into the hole; and then the boom rotated again so the ram can insert the stemming bar 16. An operator of a machine can then from the machine cabin or from behind the machine operate the transducer module 14'(being in its LOCAL mode of operation) to remotely set off the detonator 24. This process is then sequentially repeated.

It is further envisaged that the ARCH module 18 and system 10 can be used in non mining applications such as civil excavation works and for initiating fireworks etc.

A substantial benefit of the ARCH module 18 over the prior art is that there is no need to have any leads or initiating cord physically in the hole in which the detonator is located in order to initiate detonation. Such leads can act as antennas to receive stray electromagnetic fields causing the induction of currents which may prematurely initiate detonation. Also physically placing leads or cords into a blast hole is inherently dangerous due to the possibility of rock falls. As a result of this alone, the safety aspect of the ARCH module 18 is substantially greater than that in comparison to previously known devices and systems for setting off detonators. In addition the ARCH module has in built intelligence so as to not provide or deliver a detonation current even if power is induced by a stray electromagnetic field, since it must also receive and verify a valid FIRE code.

Operating safety is further enhanced by the fact that a short circuit is applied across the detonator of the ARCH module 18 until such a time as the FIRE code is received and verified. This makes it impossible for a detonating current to pass to the detonator.

Now that an embodiment of the present invention has been described in detail it will be apparent to those skilled in the relevant arts that numerous modifications and variations may be made without departing from the basic inventive concepts. For example, the frequency shift keying and pulse width modulation are used as the modulation regimes for the system 10 in the described embodiments. However other modulation schemes can be used such as coherent or noncoherent amplitude shift keying (ASK) or phase shift keying (PSK) or differentially coherent phase shift keying (DPSK). Also, different acknowledgment protocols can be used between various components of the system 10 for acknowledging receipt of various control signals and codes. Further, the predetermined time limits mentioned above, for example at states 354, 374 and 422 can be altered. It is also envisaged that it would be possible to supply power and control signals/codes to the ARCH module 18 via separate signals or fields rather than combining them on a single signal. Further, the communication and power transfer between the remote controller 12 and transducer 14' can be via cables or wires, rather than by radio communication. However it is important that communication between the transducer 14 and ARCH module 18 is by virtue of electromagnetic waves rather than by hard wiring.

All such modifications and variations are deemed to be within the scope of the present invention the nature of which is to be determined from the foregoing description and the appended claims.

The claims defining the invention are as follows:

1. A controlled electromagnetic induction detonation system for decoupled in hole initiation of an energetic substance, said system including:

an automated radio charge (ARCH) module coupled to an energetic substance and deposited in a hole formed in a hard material, the ARCH module having no permanent onboard power source but including a power circuit for extracting by means of electromagnetic induction operational power from a remotely generated electromagnetic field, the power circuit providing operational power for-the-ARCH module and arranged to generate a detonation current deliverable to the energetic substance, and means for receiving and decoding radio transmitted control signals including a FIRE code, the verified receipt of which causes delivery of the detonation current to the energetic substance;

a stemming bar for stemming the hole in which the energetic substance and ARCH module are deposited; and, a transducer unit for radio transmitting said control signals, said transducer unit having a coil for generating the electromagnetic field, the coil mounted on or in the stemming bar to effect the transfer of operational power to the ARCH module by electromagnetic induction.

2. A system according to claim 1 wherein the means for receiving and decoding the control signal extracts the control signal from said electromagnetic field.

3. A system, according to claim 2, wherein said ARCH module further includes an output switch through which said detonation current most flow, in order to initiate the energetic substance, said switch maintained as a short circuit until receipt and verification of said FIRE code, in which instance, said switch is operated to remove said short circuit and allow the detonation current to flow to the energetic substance.

4. A system, according to claim 3, wherein said transducer unit includes: a power supply for supplying power to electromagnetic field generating means for generating said electromagnetic field; and, radio transceiver means for radio transmitting said control signals to the ARCH module.

5. A system according to claim 4 wherein said transducer unit further includes means for impressing said control signals onto said electromagnetic field so that said radio transceiver means transmits both said electromagnetic field and said control signals to said ARCH module.

6. A system according to claim 4 wherein said transducer unit includes a mode switch switchable between a LOCAL mode and a REMOTE mode of operation, wherein in said LOCAL mode of operation, a user can manually input instructions to said transducer unit for radio transmission to said ARCH module and wherein in said REMOTE mode of operation, a user can input instructions to said transducer unit via a remote controller unit.

7. A system according to claim 6 wherein said transducer unit includes means for manual entry of instructions and a timer means both operationally associated with said mode switch whereby on switching said mode switch to the LOCAL mode, a user must enter via said entry means a valid identification number recognised by said transducer unit within a predetermined period of time timed by said timer means in order for further user instructions to be acted upon by said transducer unit, and in the absence of the entry of a valid identification number within said time period said transducer unit automatically shuts down so as to be non responsive to user input instructions for a second period of time timed by said timer means.

8. A system according to claim 7 wherein said transducer unit includes an ARM switch functional when said transducer unit is in the LOCAL mode of operation which, when activated causes said electric field generating means to generate said electromagnetic field.

9. A system according to claim 8 wherein said transducer unit includes a FIRE switch functional when said transducer unit is in the LOCAL mode of operation and which when activated within a predetermined time period after activation of the ARM switch causes the transducer unit to transmit the FIRE code to the ARCH module.

10. A system according to claim 6 further including a remote controller unit by which a user can communicate instructions to said transducer unit from a location remote from said transducer unit.

11. A system according to claim 10 wherein said remote controller unit includes means for the manual entry of instructions by which a user must enter a valid identification number within a predetermined time period in order for said remote controller to establish a radio communication link with said transducer unit.

12. A system according to claim 11 wherein said remote controller unit includes processor means for generating a unique identification code word which is continuously transmitted until an acknowledgment signal is received from said transducer unit corresponding to said identification code word, and wherein in the absence of receipt of said acknowledge signal within a predetermined time period said remote controller unit enters a RESET mode in which a user must once again enter a valid identification number to reinitiate the establishment of the radio communication link with said transducer unit.

13. A system according to claim 12 wherein said remote controller unit further includes an ARM switch which upon activation, when a radio communication link has been established with said transducer unit, causes the remote controller unit to transmit an ARM code to transducer unit upon which said transducer unit generates said electromagnetic field.

14. A system, according to claim 13, wherein said transducer unit sends said acknowledgment signal t6 said remote controller unit upon receipt of the ARM code and said transducer unit thereafter initiates its timer means to time a first period within which to receive a FIRE code from said remote controller unit, wherein the absence of receipt of said FIRE code within said first period said transducer unit automatically shuts down for a second period of time.

15. A system, according to claim 14, wherein said remote control unit includes a FIRE switch, which, when activated causes the remote control unit to transmit a FIRE code to said transducer unit which in turn upon on verified receipt thereof transmits said FIRE code to said ARCH module.

16. A system according to claim 15 wherein the FIRE code transmitted by the remote controller to transducer unit is different to the FIRE code retransmitted by the transducer unit to the ARCH module.

17. A controlled electromagnetic induction detonation system for initiating an energetic substance, the system including:

an automated radio charge (ARCH) module for delivering an electric detonation current to an energetic substance, said ARCH module having no permanent power source but including a power circuit for extracting power by means of electromagnetic induction from a electromagnetic field generated remotely from the ARCH module, the power circuit providing operational power for the ARCH module and the electric detonation current, and means for receiving and decoding radio transmitted control signals including a FIRE code, the verified receipt of which causes the ARCH module to deliver said current to and thereby initiate the energetic substance.

18. A system, according to claim 17, wherein the means for receiving and decoding the control signal extracts the control signal from said electromagnetic field.

19. A system, according to claim 18, wherein said ARCH module further includes an output switch through which said detonation current must flow, in order to initiate the energetic substance, said switch maintained as a short circuit until receipt and verification of said FIRE code, in which instance, said switch is operated to remove said short circuit and allow the detonation current to flow to the energetic substance.

20. A system, according to claim 19, wherein said transducer unit includes: a power supply for supplying power to electromagnetic field generating means for generating said electromagnetic field; and, radio transceiver means for radio transmitting said control signals to the ARCH module.

21. A system, according to claim 20, wherein said transducer unit further includes means for impressing said control signals onto said electromagnetic field so that said radio transceiver means transmits both said electromagnetic field and said control signals to said ARCH module.

22. A system, according to claim 21 further including a stemming bar for stemming a hole in which said ARCH module and detonator can be deposited and wherein said transducer unit includes a coil for generating said electromagnetic field, said coil mounted on or in the stemming bar so that lines of magnetic flux pass through the stemming bar and link with the power circuit to transfer operational power to the ARCH module by electromagnetic induction.

23. A system, according to claim 22, wherein said transducer unit includes a mode switch switchable between a LOCAL mode and a REMOTE mode of operation, wherein in said LOCAL mode of operation, a user can manually input instructions to said transducer unit for radio transmission to said ARCH module and wherein in said REMOTE mode of operation, a user can input instructions to said transducer unit via a remote controller unit.

24. A system, according to claim 23, wherein said transducer unit includes means for manual entry of instructions and a timer means both operationally associated with said mode switch whereby on switching said mode switch to the LOCAL mode, a user must enter via said entry means a valid identification number recognized by said transducer unit within a predetermined period of time timed by said timer means in order for further user instructions to be acted upon by said transducer unit, and in the absence of the entry of a valid identification number within said time period said transducer unit automatically shuts down so as to be non responsive to user input instructions for a second period of time timed by said timer means.

25. A system, according to claim 24, wherein said transducer unit includes an ARM switch functional when said transducer unit is in the LOCAL mode of operation which, when activated causes said electric field generating means to generate said electromagnetic field.

26. A system, according to claim 25, wherein said transducer unit includes a FIRE switch functional when, said transducer unit is in the LOCAL mode of operation and which when activated within a predetermined time period after activation of the ARM switch causes the transducer unit to transmit the FIRE code to the ARCH module.

27. A system, according to claim 26, further including a remote controller unit by which a user can communicate instructions to said transducer unit from a location remote from said transducer unit.

28. A system, according to claim 27, wherein said remote controller unit includes means for the manual entry of instructions by which a user must enter a valid identification number within a predetermined time period in order for said remote controller to establish a radio communication link with said transducer unit.

29. A system, according to claim 28, wherein said remote controller unit includes processor means for generating a unique identification code word which is continuously transmitted until an acknowledgment signal is received from said transducer unit corresponding to said identification code word, and wherein in the absence of receipt of said acknowledge signal within a predetermined time period said remote controller unit enters a RESET mode in which a user must once again enter a valid identification number to reinitiate the establishment of the radio communication link with said transducer unit.

30. A system, according to claim 29, wherein said remote controller unit further includes an ARM switch which upon activation, when a radio communication link has been established with said transducer unit, causes the remote controller unit to transmit an ARM code to transducer unit upon which said transducer unit generates said electromagnetic field.

31. A system, according to claim 30, wherein said transducer unit sends said acknowledgment signal to said remote controller unit upon receipt of the ARM code and said transducer unit thereafter initiates its timer means to time a first period within which to receive a FIRE code from said remote controller unit, wherein the absence of receipt of said FIRE code within said first period said transducer unit automatically shuts down for a second period of time.

32. A system, according to claim 31, wherein said remote control unit includes a FIRE switch, which, when activated causes the remote control unit to transmit a FIRE code to said transducer unit which in turn upon on verified receipt thereof transmits said FIRE code to said ARCH module.

33. A system, according to claim 32, wherein the FIRE code transmitted by the remote controller to transducer unit is different to the FIRE code retransmitted by the transducer unit to the ARCH module.

34. A method of decoupled in-hole initiation of an energetic substance including the steps of:

depositing an energetic substance in a hole formed in a hard material;

coupling an electronic circuit to said energetic substance;

mounting a coil on or in a stemming bar;

stemming said hole with said stemming bar;

energizing the coil to produce an electromagnetic field;

extracting from said electromagnetic field, by said electronic circuit, operational power to generate a detonation current; and, delivering said detonation current to said energetic substance to initiate said energetic substance.

35. The method according to claim 34 further including the steps of radio transmitting a control signal which includes a FIRE code;

receiving said FIRE code;

decoding said FIRE code;

verifying said FIRE code; and, wherein said delivering step is effected only after a verified receipt of said FIRE code and wherein the electronic circuit performs the steps of receiving, decoding and verifying.

36. The method according to claim 35 wherein said transmitting step includes impressing said control signal onto said electromagnetic field.

37. The method according to claim 36 further including the step of providing an output switch through which said detonation current must flow in order to initiate said energetic substance and maintaining said output switch in a short circuit condition until receipt and verification of said FIRE code; and, upon receipt and verification of said FIRE code, removing said short circuit to enable said detonation current to flow to said energetic substance.

* * * * *